US005190469A

United States Patent [19]

Mui

[11] Patent Number: 5,190,469

[45] Date of Patent: Mar. 2, 1993

[54] ELECTRICAL CORD END CONNECTOR

[76] Inventor: Cheuk Y. Mui, 41-43 39th Pl., Apt. 3C, Long Island, N.Y. 11104

[21] Appl. No.: 893,037

[22] Filed: Jun. 3, 1992

[51] Int. Cl.[5] ..... H01R 4/24

[52] U.S. Cl. ..... 439/410; 439/425

[58] Field of Search ..... 439/351-358, 439/709, 717, 716, 715, 409-413, 417-419, 395, 404, 425, 341

[56] References Cited

U.S. PATENT DOCUMENTS

| | | | |
|---|---|---|---|
| 2,658,184 | 11/1953 | Greenbaum . | |
| 2,704,832 | 3/1955 | Greenbaum . | |
| 2,745,077 | 5/1956 | Cook | 439/409 |
| 2,975,392 | 3/1961 | Ludwig | 439/409 |
| 3,369,213 | 2/1968 | Palmer . | |
| 3,408,616 | 10/1968 | Greenbaum | 439/410 |
| 4,684,195 | 8/1987 | Anderson et al. . | |
| 4,790,763 | 12/1988 | Weber et al. | 439/717 |
| 4,797,123 | 1/1989 | Weber | 439/717 |
| 4,957,452 | 9/1990 | Bolliger . | |
| 5,030,133 | 7/1991 | Rudoy | 439/409 |

*Primary Examiner*—David L. Pirlot

*Attorney, Agent, or Firm*—Jacobson, Price, Holman & Stern

[57] ABSTRACT

An electrical cord end connector is provided incorporating a pair of identical relatively pivotally body members which include stepped faces lapped engaged with each other. The body members are relatively swingable between first operative positions and second inoperative positions and support a pair of electrically conductive terminals therefrom. When the body members are disposed in the second positions one pair of corresponding edges define an outwardly opening and flared recess into which one end of a two conductor extension cord or the like may be telescoped and subsequent swinging movement of the panel members from the second positions to the first positions thereof enable the panel members to (1) mechanically clamp the extension cord end thereto and (2) effect good electrical connection between each of the extension cord conductors and an associated electrically conductive terminal of the connector. A first form of connector incorporates a pair of male plug prong defining terminals and a second form of the connector defines a pair of male plug prong receiving recesses into which portions of the corresponding terminals laterally project.

10 Claims, 3 Drawing Sheets

3-

ELECTRICAL CORD END CONNECTOR

BACKGROUND OF THE INVENTION

1. Field of the Invention

This invention relates to an electrical cord end connector, either a plug or receptacle, which may be operatively electrically connected to the two conductors of a two conductor electrical cord with ease, in a swift manner and with the connector also affording a strong mechanical connection with the electrical cord in addition to the electrical connection therewith.

2. Description of Related Art

Various different forms of electrical cord end connectors including some of the general structural and operational features of the instant invention heretofore have been provided. Examples of these previously known forms of connectors are disclosed in U.S. Pat. Nos. 2,658,184, 2,704,832, 3,369,213, 4,684,195 and 4,957,452. However, these previously known forms of connectors do not enjoy the overall structural and operational features of the instant invention which enable the connector to be provided by utilizing a single pair of identical insulative body parts, a single pair of identical electrical conductive parts and a single pivot fastener. By providing an electrical cord end connector of this type a useful product may be produced at a very low cost. In addition, the electrical connector of the instant invention provides structure not only for providing a good electrical connection with the conductors of a two conductor electrical cord but also for providing a strong mechanical connection with the electrical cord.

SUMMARY OF THE INVENTION

The electrical cord end connector of the instant invention utilizes a pair of identical insulative body components which are in the form of stepped panel members having corresponding stepped first and second outwardly facing opposite side faces and corresponding edges extending about the faces. The panel members are lap engaged with each other and pivotally secured together such that the panel members may be pivoted between first and second inoperative and operative positions, respectively. The panel members are lap engaged such that the stepped faces oppose and are interfitted with each other when the panel members are in their first operative positions.

When the panel members are in their second inoperative positions, an outwardly flared socket is defined between opposing surfaces of the panel members into which one end of a two conductor electrical cord may be seatingly telescoped, the connector serving to automatically establish electrical connection between identical electrically conductive components thereof and the conductors of the electrical cord as well as to establish a firm mechanical connection with the electrical cord end when the panel members are swung from their second inoperative positions to their first operative positions. The panel members further include resiliently releasable latch structures for automatically latching the panel members in the first operative positions thereof upon their being pivoted to the first positions from the second positions thereof.

The main object of this invention is to provide an electrical cord end connector which may be readily utilized by even inexperienced persons to properly provide an end connector on one end of an electrical cord.

Another object of this invention is to provide an end connector in accordance with the preceding object and which may be in form of a receptacle or a male plug.

Still another object of this is to provide an electrical cord end connector which utilizes, in addition to a pivot fastener, only two separate parts, one of which parts comprises a insulative body or panel member and the other of which parts comprises an electrical conductive part, each cord end connector utilizing a pair of the insulative panel members and a pair of the electrically conductive parts.

Another very important object of this invention is to provide an electrical cord end connector concluding relatively movable body components which may be shifted between inoperative and operative positions and which include resiliently releasable latch structure for retaining the body components in the operative positions thereof.

Still another important object, in accordance with the immediately preceding object, is to provide an electrical cord end connector whose latch structure incorporates a double latch system which may be readily actuated by an adult to simultaneously release both latches as a result of opposing inward finger pressure applied to opposite sides of the body of the end connector, but which will be very difficult for pre-school age children to release.

A final object of this invention to be specifically enumerated herein is to provide an electrical core end connector in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 5:
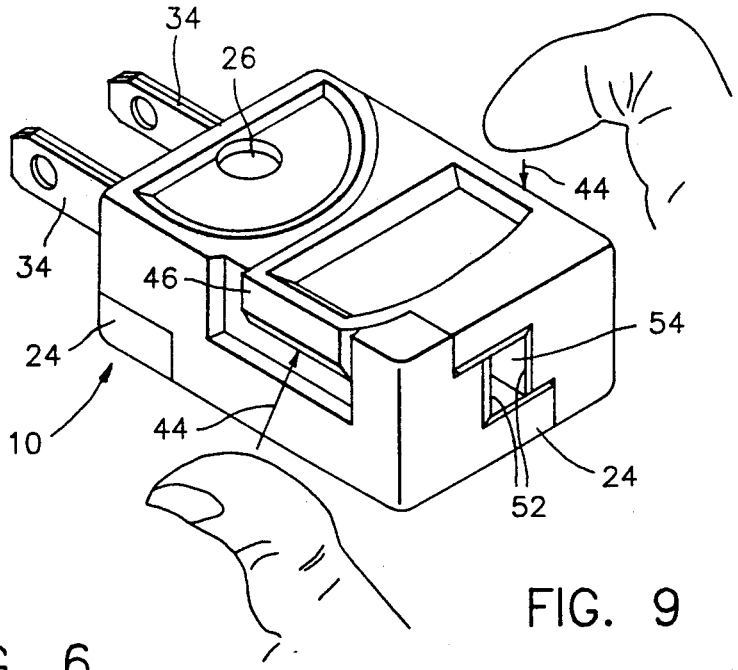
FIG. 5 is a perspective view of the plug form of connector illustrating the manner in which opposite directional FIGURE pressure may be utilized to release the double latching mechanism of the connector.

Referring now more specifically to the drawings the numeral 10 generally designates, in FIG. 5, a male plug-type electrical cord connector constructed in accordance with the present invention.

The connector 10 includes a pair of identical panel or body members 12 and 14 constructed cf shape retentive but slightly resiliently deformable plastic material. The body members or components 12 and 14 each include oppositely directed faces 16 and 18, the faces 16 being stepped as at 20 and the faces 18 being stepped as at 22.

The body members 14 are generally in the form of panel members wherein the faces 16 and 18 define generally horizontal surfaces which are bound by substantially vertical peripheral edges 24.

Figure 3:
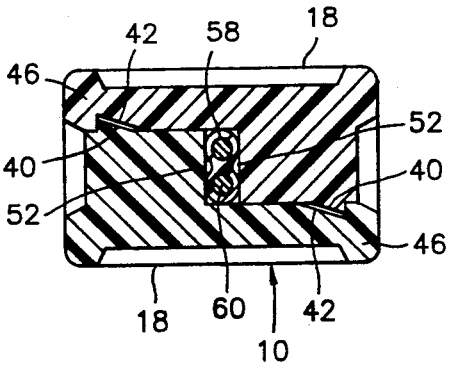
FIG. 3 is a slightly enlarged transverse sectional view illustrating the double latching mechanism whereby the body members of the connector are releasably retained in the operative positions thereof.
Figure 6:
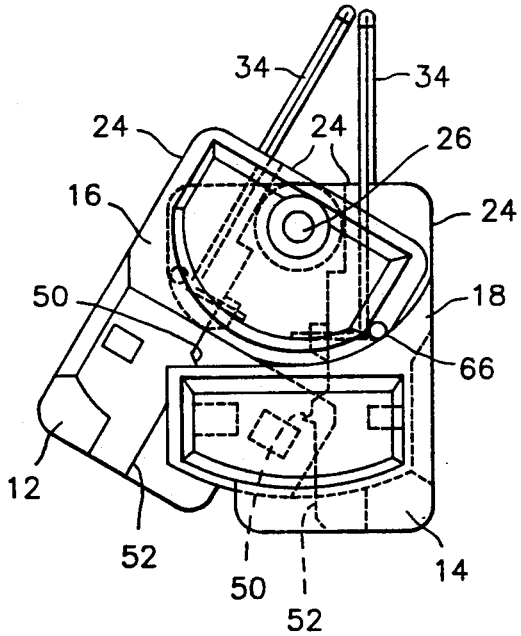
FIG. 6 is a top plan view of the connector with the body members or components thereof in the inactive positions.
Figure 9:
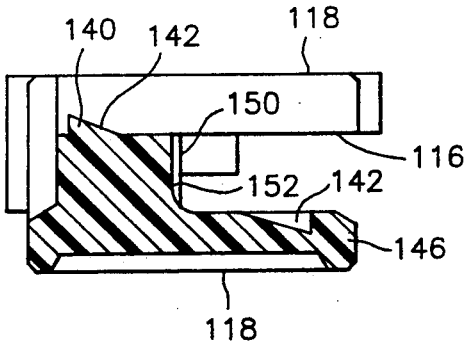
FIG. 9 is a sectional view illustrating the double latch features of one of the receptacle connector body members.
Figure 10:
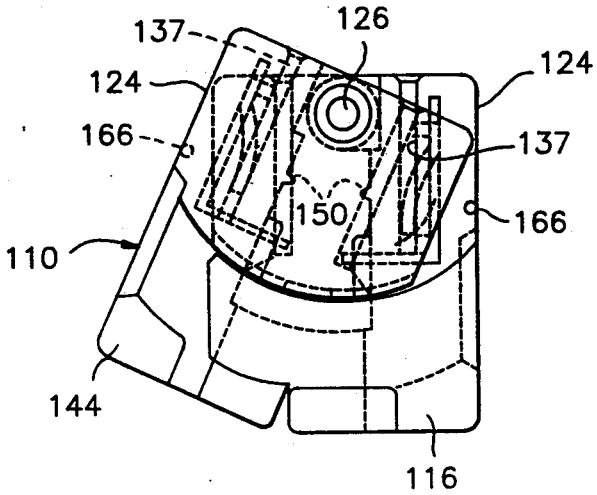
FIG. 10 is a top plan view illustrating the receptacle form of connector with the body components thereof in their inoperative positions.
Figure 7:
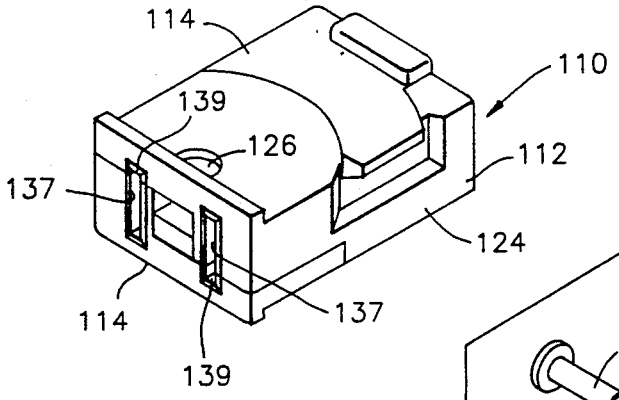
FIG. 7 is an exploded perspective view similar to FIG. 1 but illustrating the receptacle form of connector.
Figure 7A:
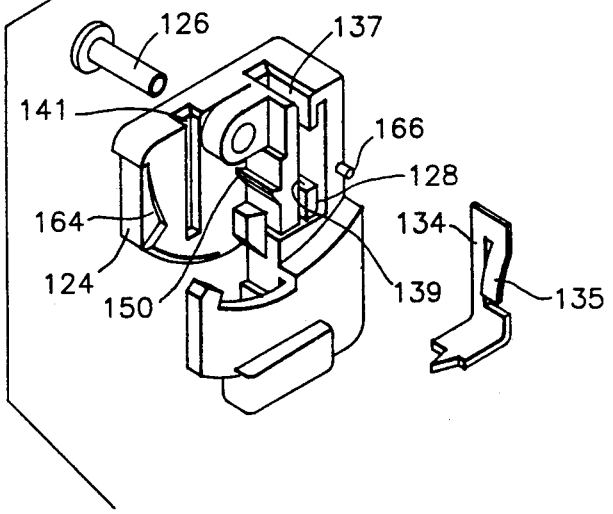
FIG. 7A is a perspective view of one of the body members of the receptacle connector and further illustrating the pivot connector and the associated electrically conductive terminal in exploded positions.
Figure 7B:
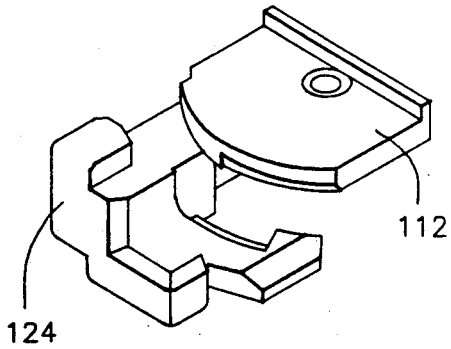
FIG. 7B is a perspective of one of the body members of the receptacle connector as seen from a difficult angle.
Figure 8:
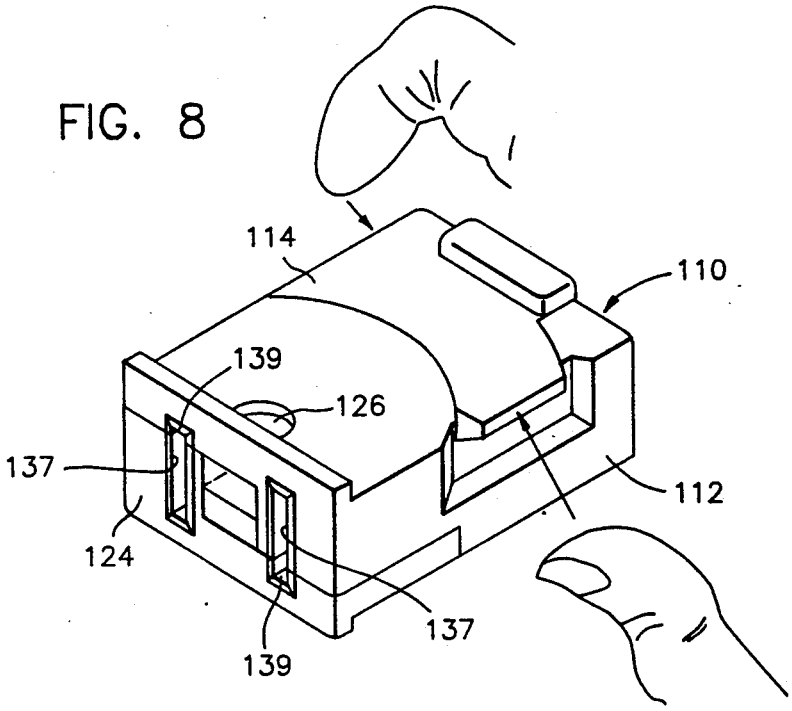
FIG. 8 is a perspective view similar to FIG. 5 but illustrating the receptacle form of the connector.

The identical body members 12 and 14 are inverted relative to each other and disposed in vertically lapped engagement with each other with the stepped portions 20 of the surfaces 16 and the stepped portions 22 of the surfaces 18 lap engaged with each other, a pivot fastener 26 being provided for pivotally joining the body members 12 and 14 for limited relative angular displacement between the closed operative positions thereof illustrated in FIGS. 3 and 5 and the open positions thereof illustrated in FIG. 6.

Figure 1:
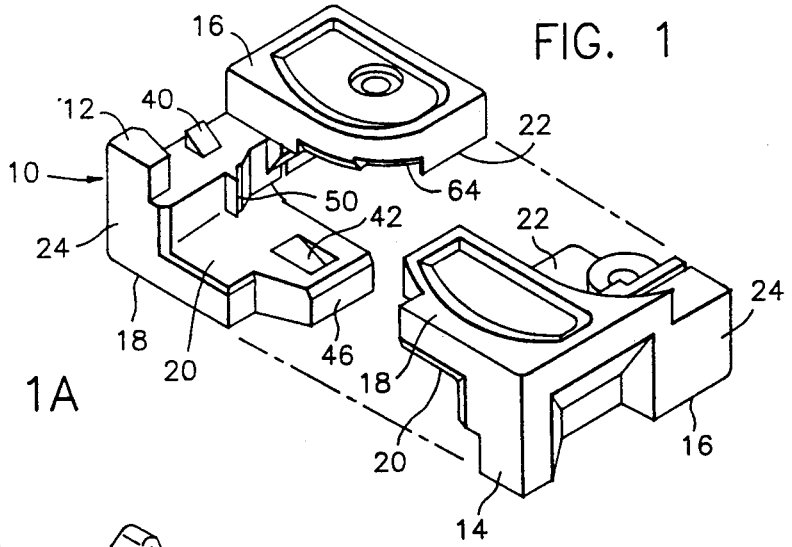
FIG. 1 is an exploded perspective view of the two body components or panel ,members of the end connector.
Figure 1A:
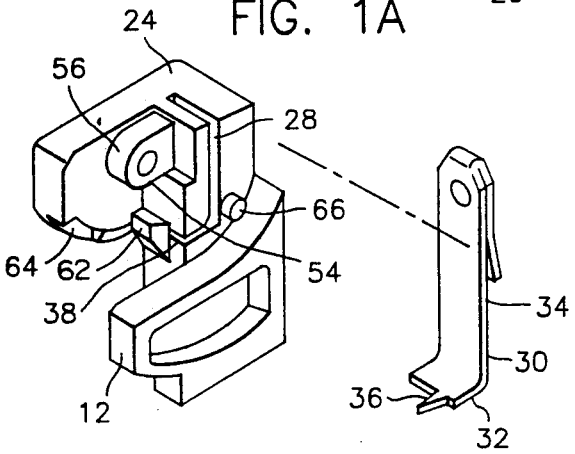
FIG. 1A is an exploded perspective view of one of the body components of the end connector and the associated electrically conductive terminal.

With attention now invited more specifically to FIG. 1A, it may be seen that each body member 12 and 14 includes an L-shaped groove 28 in which the adjacent portions of the long and short legs 30 and 32 of an electrically conductive terminal 34 are received, the short leg 32 including a laterally offset insulation piercing prong 36 which projects outwardly of the slot 28 in the area 38 thereof illustrated in FIG. 1A.

Figure 2:
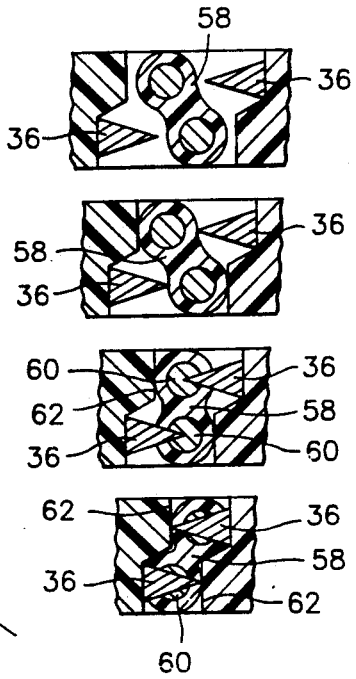
FIG. 2 is a plurality of enlarged fragmentary sectional views illustrating sequential steps of relative pivotal movement of the body members or components of the connector as they are moved from their inoperative positions toward their operative positions and illustrated the manner in which the insulation piercing elements of the associated electrically conductive terminals function to pierce the insulation of the associated two conductor electrical cord.
Figure 4:
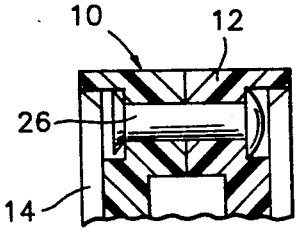
FIG. 4 is an enlarged fragmentary vertical sectional view illustrating the pivot connector secured between the body members of the connector.

The prongs 36 supported from the body members 12 and 14 are offset relative to each other along the center axis of the pivot fastener or rivet 26 a shown in FIG. 2.

From FIG. 1 of the drawings it may be seen that the body members 12 and 14 each include a triangular shaped latching lug 40 and a triangular latching recess 42, the latching lug 40 of each body member coacting with the latching recess 42 of the other body member to secure the body members 12 and 14 in their latched operative positions illustrated in FIG. 5. However, inasmuch as the body members 12 and 14 are constructed of a shape retentive but slightly insulative material such as plastic, finger pressure in the direction of the arrows 44 may be applied to the portions 46 shown in FIGS. 1, 3 and 5 in order to bias the latching recesses 42 of the portions 46 away from the latching lugs 40. If such finger pressure is applied in parallel planes inclined approximately 30 degrees relative to the faces 16 and 18, the body members 12 and 14 automatically will be pivoted from the operative closed position illustrated in FIG. 3 to the inoperative open positions illustrated in FIG. 6 as the latches are released.

With attention now invited more specifically to FIG. 1, it may be seen that each body member 12 and 14 includes a pinching or clamp ridge 50 paralleling the corresponding axis of oscillation. The clamping ridges 50 are disposed opposite each other and project inwardly from opposite sides 52 of a recess 54 opening outwardly of one side edge of the connector 10, the sides 52 generally paralleling each other when the body members 12 and 14 are in the operative positions and being outwardly divergent when the panel members 12 and 14 are in the inoperative positions.

The recess 54 extends inwardly to the surfaces 54 of the lugs 56 formed on the body members 12 and 14 and the surfaces 54 define abutment surfaces to limit penetration of one end of the electrical cord 58 into the recess 54 when the body members 12 and 14 are in their open positions.

After insertion of on end of the electrical cord 58 into the recess 54 when the body members 12 and 14 are in their open positions, the body members 12 and 14 are swung toward their closed operative positions. During such relative pivotal movement the clamping ridges 50 first clampingly engage the inserted end of the electrical cord 58 in order to physically anchor the cord 58 in position relative to the body members 12 and 14. Then, as the body members 12 and 14 are further pivoted toward their closed operative positions illustrated in FIG. 5, the piercing elements 36 engage and twist the opposing portions of the electrical 58 to the inclined positions thereof illustrated in the upper two showings of FIG. 2. Thereafter, the piercing elements penetrate the insulation of the electrical cord 58 and the conductors 60 as shown in the lower two showings of FIG. 2, the surfaces 62 opposing the piercing elements 36 serving to ensure full penetration of the elements 36 into the conductors 60.

As the members 12 and 14 swing to the fully closed positions thereof illustrated in FIG. 5, the latching lugs 40 seat in the latching recesses 42. Also, the body members 12 and 14 include notches 64 with which bosses 66 are operatively associated in order to limit angular displacement of the body members 12 and 14 between the open and closed positions thereof after the body members 12 and 14 have been assembled.

With attention now invited more specifically to FIGS. 7–10 of the drawings, there may be seen a modified form of the connector referred to in general by the reference numeral 110. The connector 110 includes identical body members 112 and 114 corresponding to the body members 12 and 14 and the various components of the body members 112 and 114 corresponding directly to the previously described components of the body member 12 and 14 are referred to by reference numerals in the one hundred series corresponding to the reference numeral given those components of the body members 12 and 14.

The connector 110 differs primarily from the connector 10 in that the terminals 134 thereof receivable in the slots 128 comprise internal terminals as opposed to the outwardly projecting plug prong defining terminals 34. In addition, the terminals 134 include spring prong portions 135 which project inwardly of the outer sides of the plug prong receiving opening segments 137 through windows 139 provided therefore, the plug prong receiving recesses also including segments 141 thereof.

Accordingly, it may be seen that the connector 110 is generally similar to the connector 10 with the main difference being that the connector 110 includes internal plug prong contacting spring prong portions 135 while the connector 10 includes external prongs.

These together with other objects and advantages which will become subsequently apparent reside in the details of construction and operation as more fully hereinafter described and claimed, reference being had to the accompanying drawings forming a part hereof, wherein like numerals refer to like parts throughout.

What is claimed as new is as follows:

1. An electrical cord end connector for providing a pair of terminals electrically connected to the conductors of a two conductor electrical cord, said connector including a pair of substantially identical panel members having corresponding stepped first and second outwardly facing opposite side faces and corresponding edges extending about said faces, pivot means pivotally securing said panel members together with said first stepped faces opposing and interfitted with each other and with said panel members being relatively angularly displaceable about a predetermined axis between first and second positions, said panel members each including a elongated electrically conductive terminal supported therefrom, said panel members, when in said second positions, being positioned with said elongated electrically conductive terminals disposed in generally the same diametric plane of said axis and convergent in a direction extending outwardly of a first corresponding pair of said edges and defining a socket having opposing outwardly divergent sides opening outwardly of a second corresponding pair of said edges opposite said first pair of edges and, when in said first positions, being relatively rotated to positions with said elongated conductive members being generally parallel and disposed generally normal to said first corresponding edges and with said socket sides swung toward each other and disposed in closely spaced generally parallel relation, said terminals each including an insulation piercing element projecting inwardly of a corresponding socket side toward the other socket side with said elements being disposed in axially spaced diametric planes of said axis, said elements, when said panel are swung from said second positions to said first positions, being swingable to positions at least closely adjacent the opposing socket sides for piercing the insulation of a conductor disposed between said elements and the opposing socket sides.

2. The cord end connector of claim 1 wherein said terminals project outwardly of said first pair of edges.

3. The cord end connector of claim 1 wherein said panel members, when in said first positions define, together, a generally rectangular plug body.

4. The cord end connector of claim 1 wherein said pivot means comprises a pivot rivet secured through axially lapped portions of said stepped panel members.

5. The cord end connector of claim 1 wherein said panel members include first coacting abutment means limiting relative movement of said panel members from said first positions to said second positions and coacting resiliently releasable latch means operative to retain said panel members in said first positions.

6. The cord end connector of claim 1 wherein each of said piercing elements is spaced a predetermined distance radially outward of said axis and said panel members include a pair of opposing clamping ridges paralleling said axis, projecting inwardly of said socket sides and spaced radially outwardly of said axis a distance less than the radial spacing of said piercing elements from said axis, said clamping ridges, when said panel members are in said first positions, being operable to mechanically clamp said cord end portion therebetween.

7. The cord end connector of claim 1 wherein said terminals are contained within a pair of elongated, generally parallel recesses opening endwise outwardly of said first pair of edges in directions generally normal thereto.

8. The cord end connector of claim 7 wherein said terminals are disposed at the remote sides of said recesses.

9. In an assemblage including a pair of structurally identical panel-like body members each incorporating first and second oppositely facing faces and wherein said body members are disposed in superposed relation with said second faces opposing each other, pivot means securing said body members together against axial separation and for relative angular displacement about an axis extending between said first and second faces of each of said body members, for relative pivotal movement of said body members between first and second limit positions, said body members each including opposite marginal portions facing in opposite directions laterally of said axis, each of said body members including a projection projecting outwardly of the second face thereof adjacent one of said side marginal portions and a recess opening outwardly of the second face thereof adjacent the other of said side marginal portions, the projections and recesses of said body members being operative to latch said body members in said first positions against swinging movement to said second positions, said body members being constructed of shape retentive, but resilient material such that deflection of one of said marginal portions facing in each of said opposite directions may displace said one marginal portion along said axis sufficient to disengage the corresponding projection from the associated recess.

10. An electrical cord end connector for providing a pair of terminals electrically connected to the conductors of a two conductor electrical cord, said connector including a pair of substantially identical panel members having corresponding first and second outwardly facing opposite side faces and corresponding edges extending about said faces, pivot means pivotally securing said panel members together with said first faces opposing each other and with said panel members being relatively angularly displaceable about a predetermined axis between first and second positions, said panel members each including an elongated electrically conductive terminal supported therefrom, said panel members, when in said second positions, being positioned with said elongated electrically conductive terminals disposed in generally the same diametric plane of said axis and convergent in a direction extending outwardly of a first corresponding pair of said edges and defining a socket having opposing outwardly divergent sides opening outwardly of a second corresponding pair of said edges opposite said first pair of edges and, when in said first positions, being relatively rotated to positions with said elongated conductive members being generally parallel and disposed generally normal to said first corresponding edges and with said socket sides swung toward each other and disposed in closely spaced generally parallel relation, said terminals each including an insulation piercing element projecting inwardly of a corresponding socket side toward the other socket side with said elements being disposed in axially spaced diametric planes of said axis, said elements, when said panel are swung from said second positions to said first positions, being swingable to positions at least closely adjacent the opposing socket sides for piercing the insulation of a conductor disposed between said elements and the opposing socket sides.

* * * * *